US010526127B2

(12) United States Patent
Leung et al.

(10) Patent No.: US 10,526,127 B2
(45) Date of Patent: Jan. 7, 2020

(54) TWO PIECE WET-TISSUE CANISTER CLOSURE WITH AN ELASTIC HINGE WITH AN OPENING ANGLE STOP, A SINGLE SHEET DISPENSING ORIFICE, AND TAIL STORAGE

(71) Applicants: Valentin Leung, Tsuen Wan (HK); John Violett, Tsuen Wan (HK)

(72) Inventors: Valentin Leung, Tsuen Wan (HK); John Violett, Tsuen Wan (HK)

(73) Assignee: Global Dispensing Ltd, Tsuen Wan (HK)

( * ) Notice: Subject to any disclaimer, the term of this patent is extended or adjusted under 35 U.S.C. 154(b) by 0 days.

(21) Appl. No.: 14/569,331

(22) Filed: Dec. 12, 2014

(65) Prior Publication Data

US 2015/0164290 A1 Jun. 18, 2015

Related U.S. Application Data

(60) Provisional application No. 61/915,490, filed on Dec. 12, 2013.

(51) Int. Cl.

| | |
|---|---|
| ***B65D 81/22*** | (2006.01) |
| ***B65D 83/08*** | (2006.01) |
| *A47K 10/32* | (2006.01) |

(52) U.S. Cl.
CPC ..... *B65D 81/22* (2013.01); *A47K 2010/3266* (2013.01)

(58) Field of Classification Search
CPC ..... A47K 10/42
See application file for complete search history.

(56) References Cited

U.S. PATENT DOCUMENTS 6,182,858 B1 * 2/2001 Hartog ..... A47K 10/3818 221/63
6,499,626 B1 * 12/2002 Julius ..... A47K 10/421 221/303

OTHER PUBLICATIONS

National Parts Depot Spring Fuel Door Hinge U-Shaped https://www.npdlink.com/product/spring-fuel-door-hinge-u-shaped-c8az-62405a24-a/178757 (Year: 1993).*

* cited by examiner

*Primary Examiner* — Jacob S. Scott
*Assistant Examiner* — Ayodeji T Ojofeitimi
(74) *Attorney, Agent, or Firm* — White-Welker & Welker, LLC; Matthew T. Welker, Esq.

(57) ABSTRACT

A lid that can be open with a flip of a finger, once opened, the lid will hold its position with the help of a stopper and force store in an elastic hinge. This will provide the user with a very opened and clear view on the canister content. If it's a first time use, the user may reach the content through a wide orifice through the body, and pull the lead of the roll through it, then, by passing towards the tearing and holding pattern orifice, the user will be able to cleanly tear one sheet, the holding pattern holding the thread in place ready for later use. The user then flips the lid down in order to close it.

3 Claims, 17 Drawing Sheets

TWO PIECE WET-TISSUE CANISTER CLOSURE WITH AN ELASTIC HINGE WITH AN OPENING ANGLE STOP, A SINGLE SHEET DISPENSING ORIFICE, AND TAIL STORAGE

CROSS REFERENCE TO RELATED APPLICATIONS

This application claims priority from U.S. Provisional Patent Application Ser. No. 61/915,490, entitled "A two piece wet-tissue canister closure with an elastic hinge with an opening angle stop and a single sheet dispensing orifice", filed on 12 Dec. 2013. The benefit under 35 USC § 119e of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to container lids. More specifically, the present invention relates to a closure with an elastic hinge with an opening angle stop and a single sheet dispensing orifice.

BACKGROUND OF THE INVENTION

When reaching for a wet-tissue from a canister, one often grabs the canister body with one hand, then with his other hand, pry open the lid, as he wants to reach the wet-tissue inside the canister, the lid might flip back over the opening, being in the way to reach the content, once reached, the user might not be able to pull one sheet from the roll as the orifice is not design well enough to hold and tear the sheet from the roll. The wet-tissue needs to be capped by a moisture seal lid in order to prevent lotion to evaporate from the wet-tissues.

The conventional canister closure are usually made from a single plastic piece, cap and lid linked through a living hinge, they are molded in an opened position and closed immediately after molding, leaving internal stresses, hence because of these residual stresses, the lid trends to rotate back to its closed position. The user will have the lid touching the back of his hands while trying to access the content of the canister. They require the user to hold the lid with one hand while reaching the canister content with the other hand. Therefore, user is less convenient to use it.

Some orifice designs are too complex requiring the user to thread a sheet of tissue through the orifice using a small device or requires the user to disassemble the closure from the canister to do it. Also, some orifices do not tear and/or hold the tissue, so the user needs to tear tissues by himself. Some storage areas are not sufficient for the tissue tail to fit in, and therefore the tail may disturb the closing motion.

Therefore, what is needed is a closure that solves these problems while also being cost effective to manufacture.

SUMMARY OF THE INVENTION

The present invention has a lid that can be open with a flip of a finger, once opened, the lid will hold its position with the help of a stopper and force store in an elastic hinge. This will provide the user with a very opened and clear view on the canister content. If it's a first time use, the user may reach the content through a wide orifice through the body, and pull the lead of the roll through it, then, by passing towards the tearing and holding pattern orifice, the user will be able to cleanly tear one sheet, the holding pattern holding the thread in place ready for later use. The tail will store in the big storage area. The user then flips the lid down in order to close it.

TABLE OF NUMERICAL REFERENCES

| | |
|---|---|
| 9 | Two piece wet-tissue canister |
| 10 | Lid |
| 11 | Cap |
| 12 | Canister |
| 13 | Lid body |
| 14 | Latch |
| 15 | Sealing rib |
| 16 | Stopper geometrics |
| 17 | Retaining hooks |
| 18 | U spring |
| 19 | Canister snapping feature |
| 20 | Living hinge |
| 21 | Reach in area |
| 22 | Shell body |
| 23 | Retaining slots |
| 24 | Orifice |
| 25 | Guiding teeth |
| 26 | Front teeth |
| 27 | Back teeth |
| 28 | Retaining features |
| 29 | Tail storage |
| 30 | Tearing area |
| 31 | Sealing ring "A" |
| 32 | Guiding cap |

BRIEF DESCRIPTION OF THE DRAWINGS

The accompanying drawings, which are incorporated herein form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
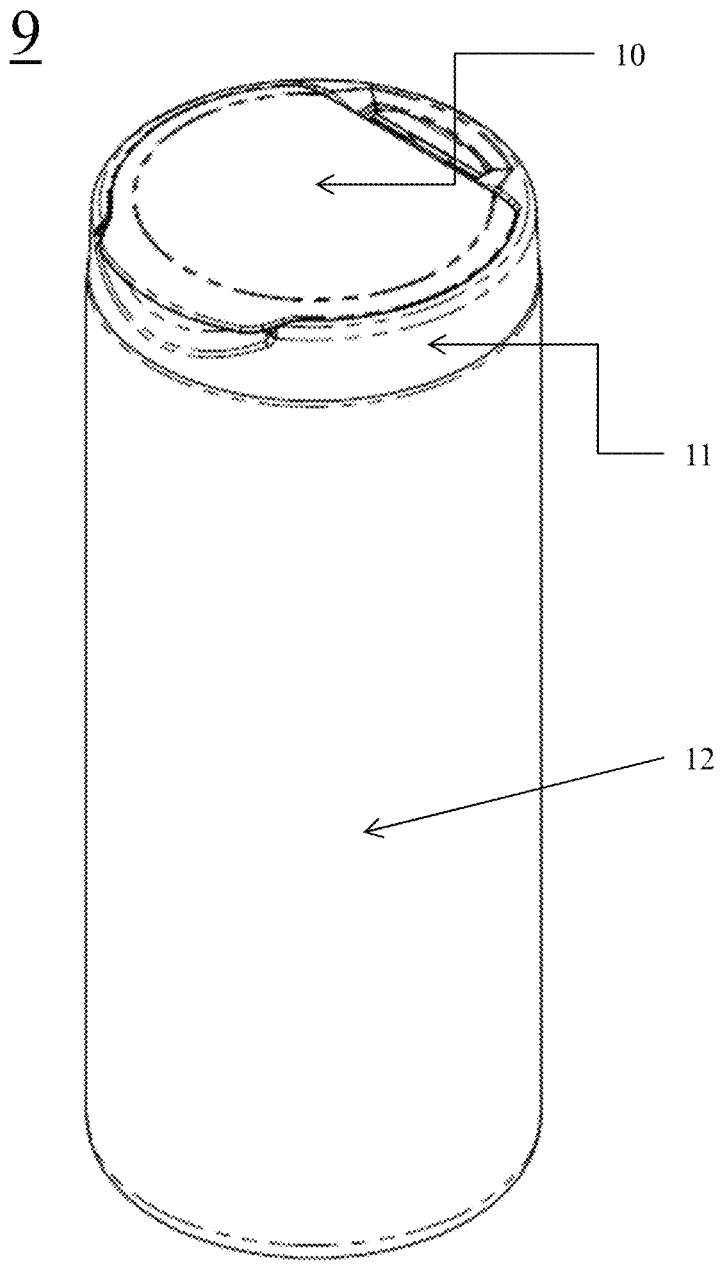
FIG. 1: Assembled View of the 2 piece canister closure on a canister of the present invention.
Figure 2:
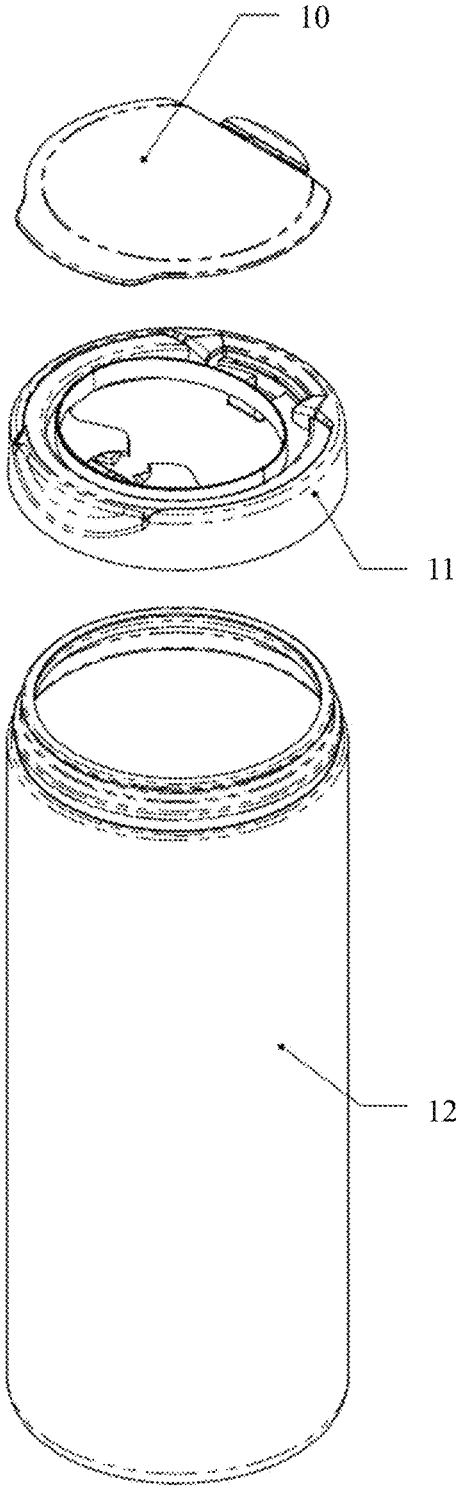
FIG. 2: Exploded View of the 2 piece canister with a canister of the present invention.
Figure 3A:
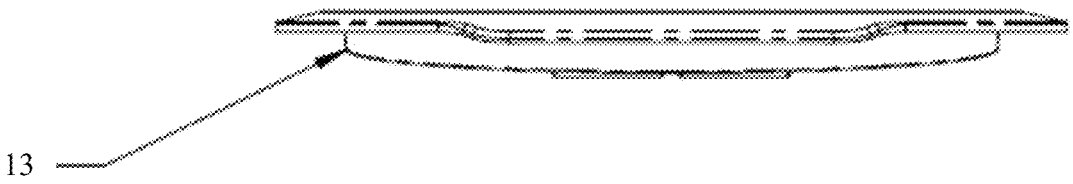
FIGS. 3*a*-3*b*: Front Exploded View of the 2 piece canister closure of the present invention.
Figure 3B:
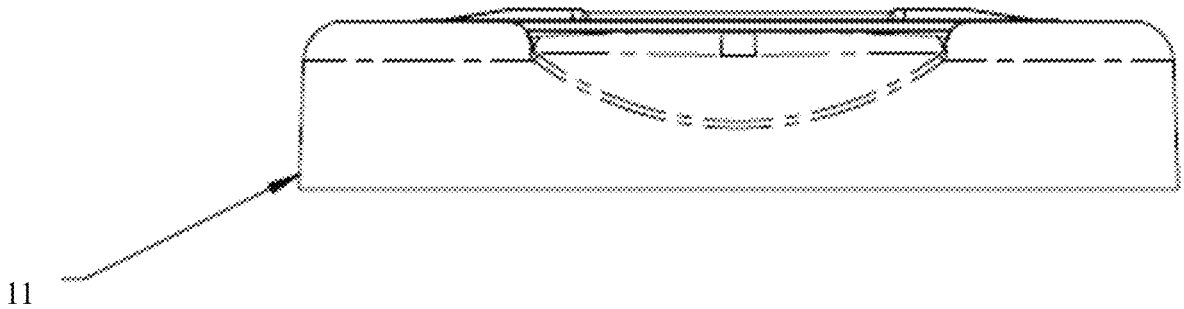
Figure 4A:
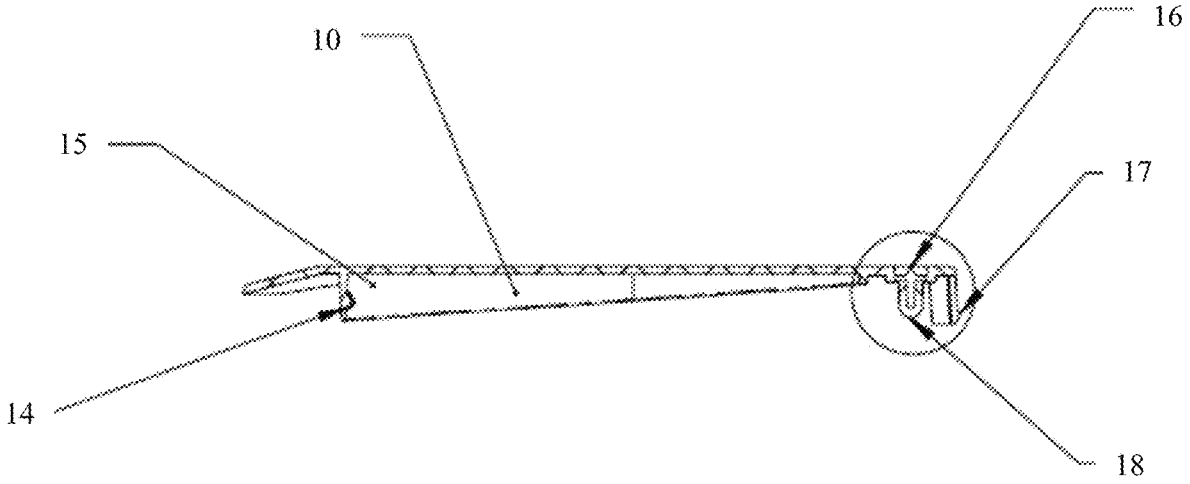
FIGS. 4*a*-4*b*: Side section view of the 2 piece canister closure of the present invention.
Figure 4B:
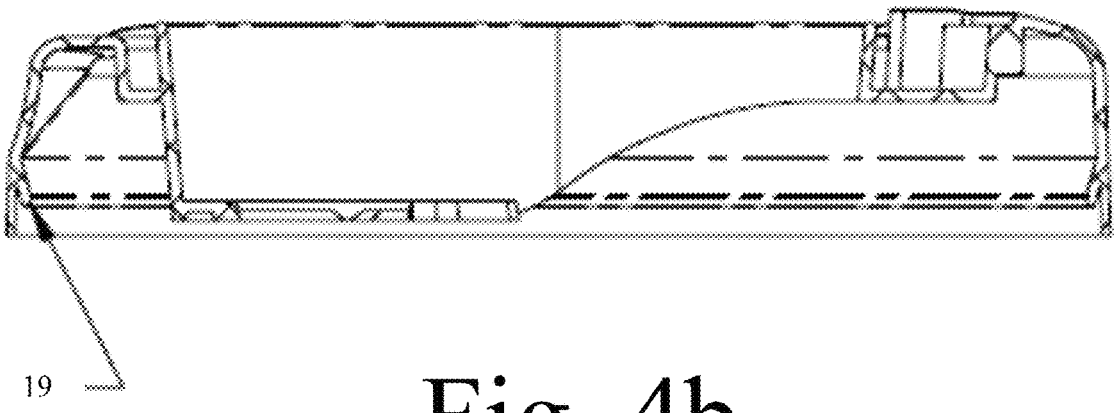
Figure 5:
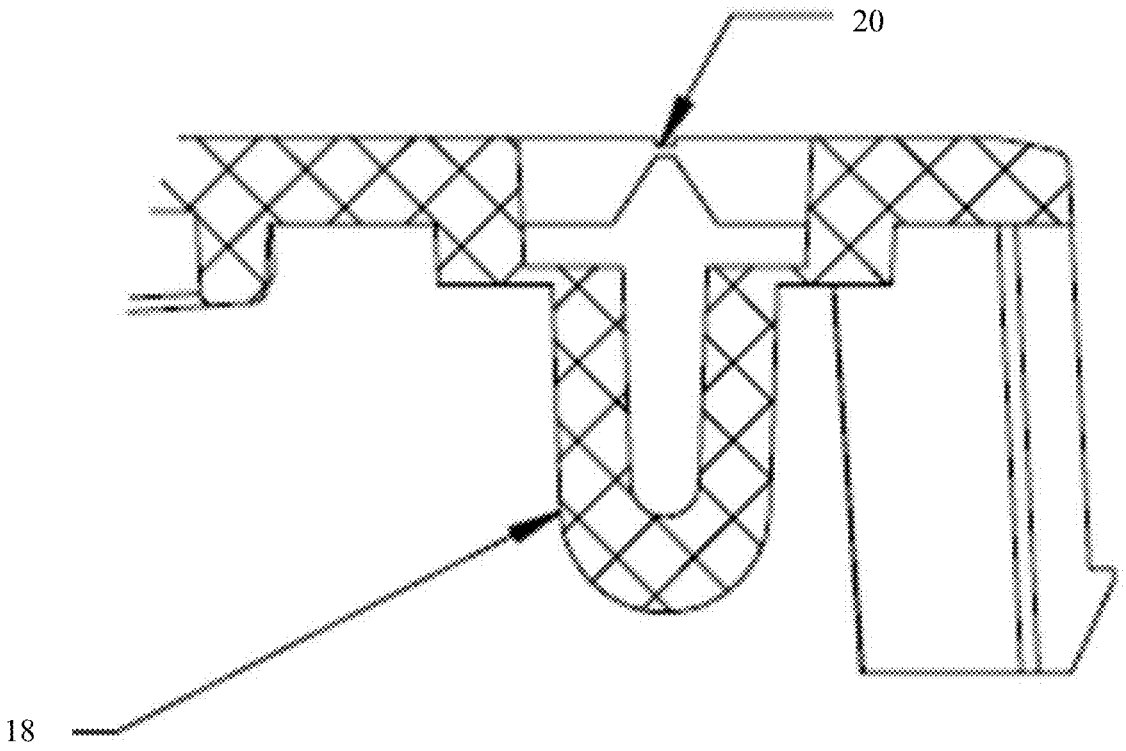
FIG. 5: Close-up on the elastic hinge area of the lid of the present invention.
Figure 6:
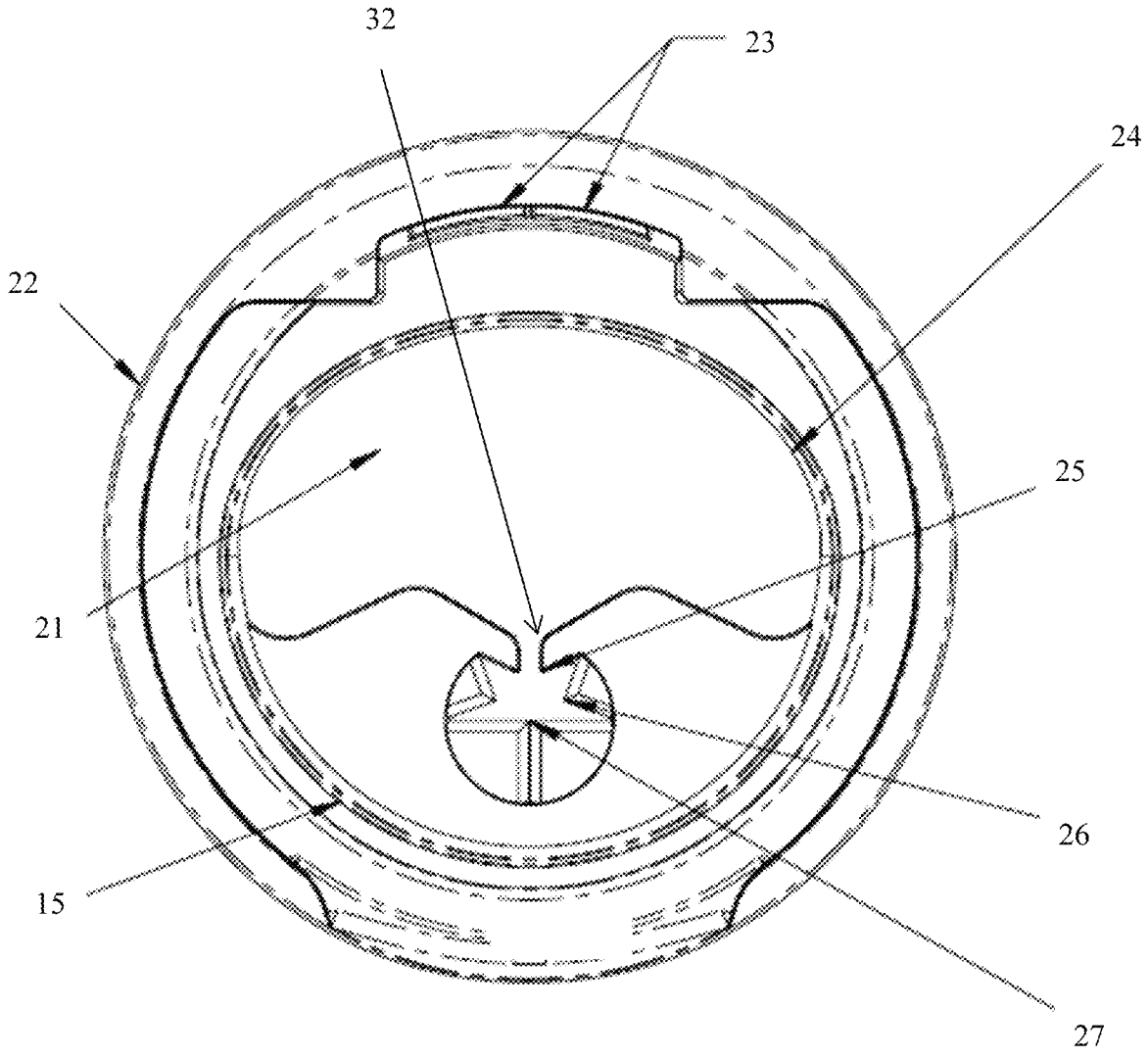
FIG. 6: Top view of the cap of the present invention.
Figure 7:
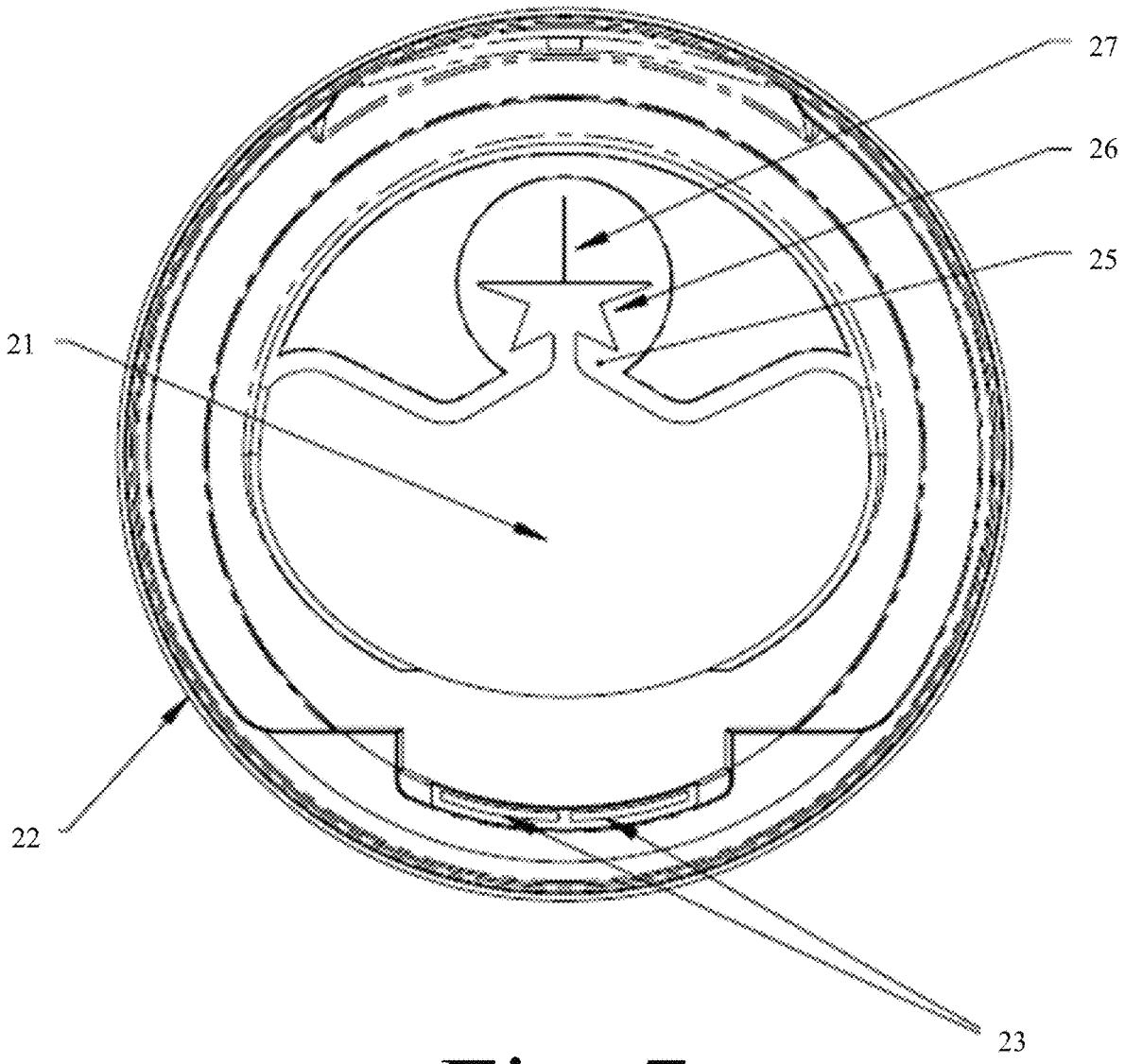
FIG. 7: Bottom view of the cap of the present invention.
Figure 8:
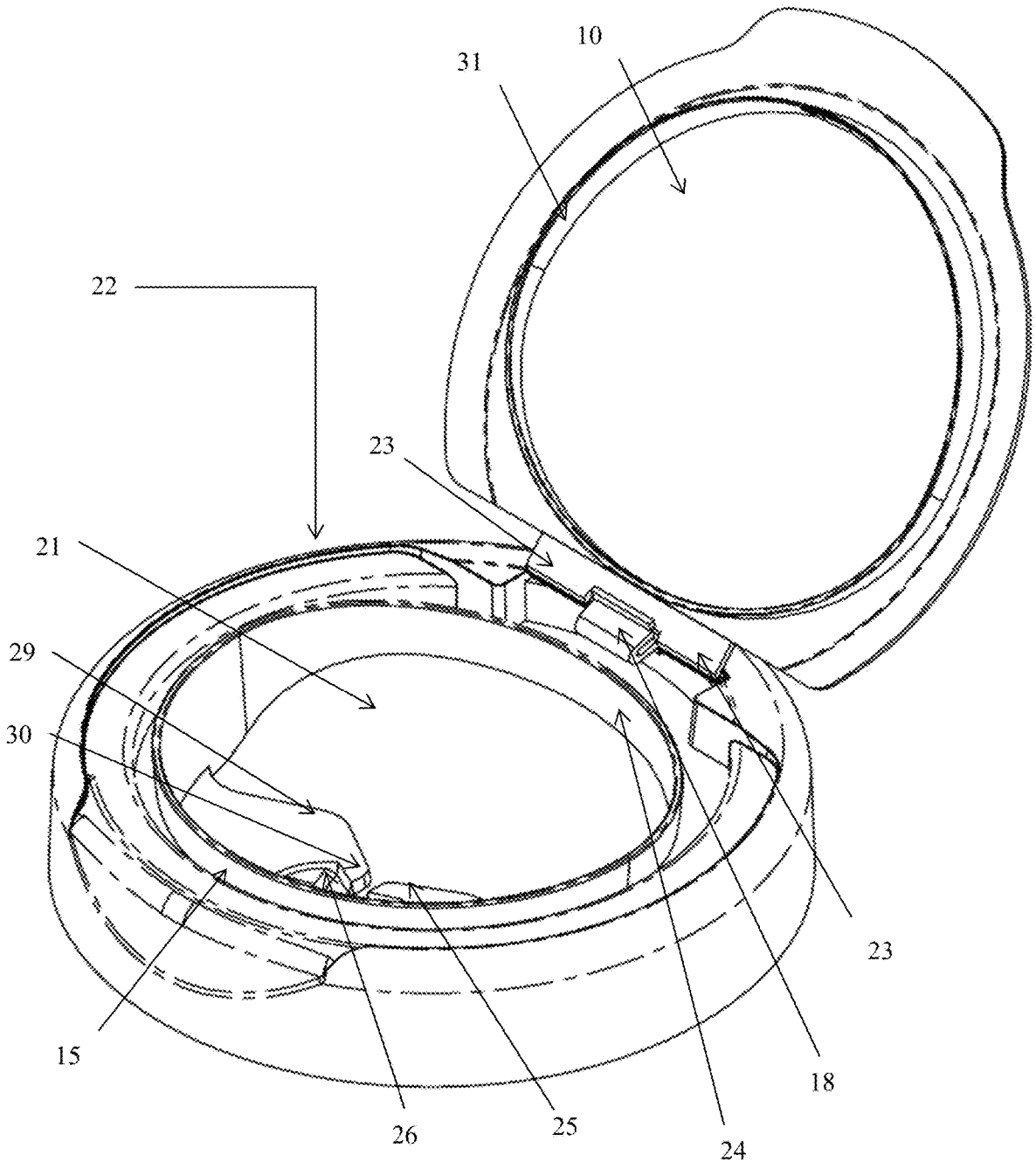
FIG. 8: Isometric view of the opened 2 piece canister closure Assembly of the present invention.
Figure 9:
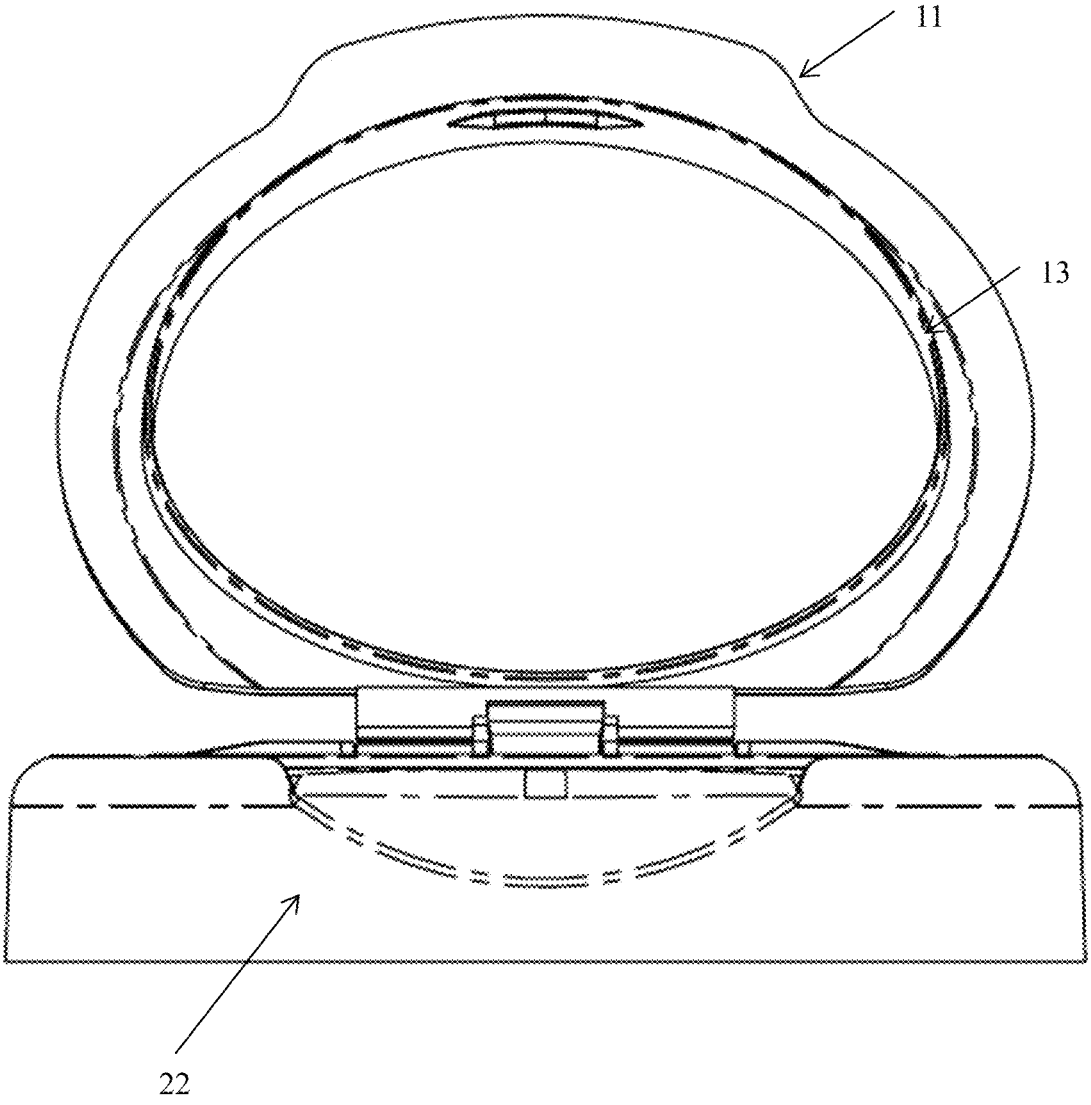
FIG. 9: Front view of the opened 2 piece canister closure Assembly of the present invention.
Figure 10:
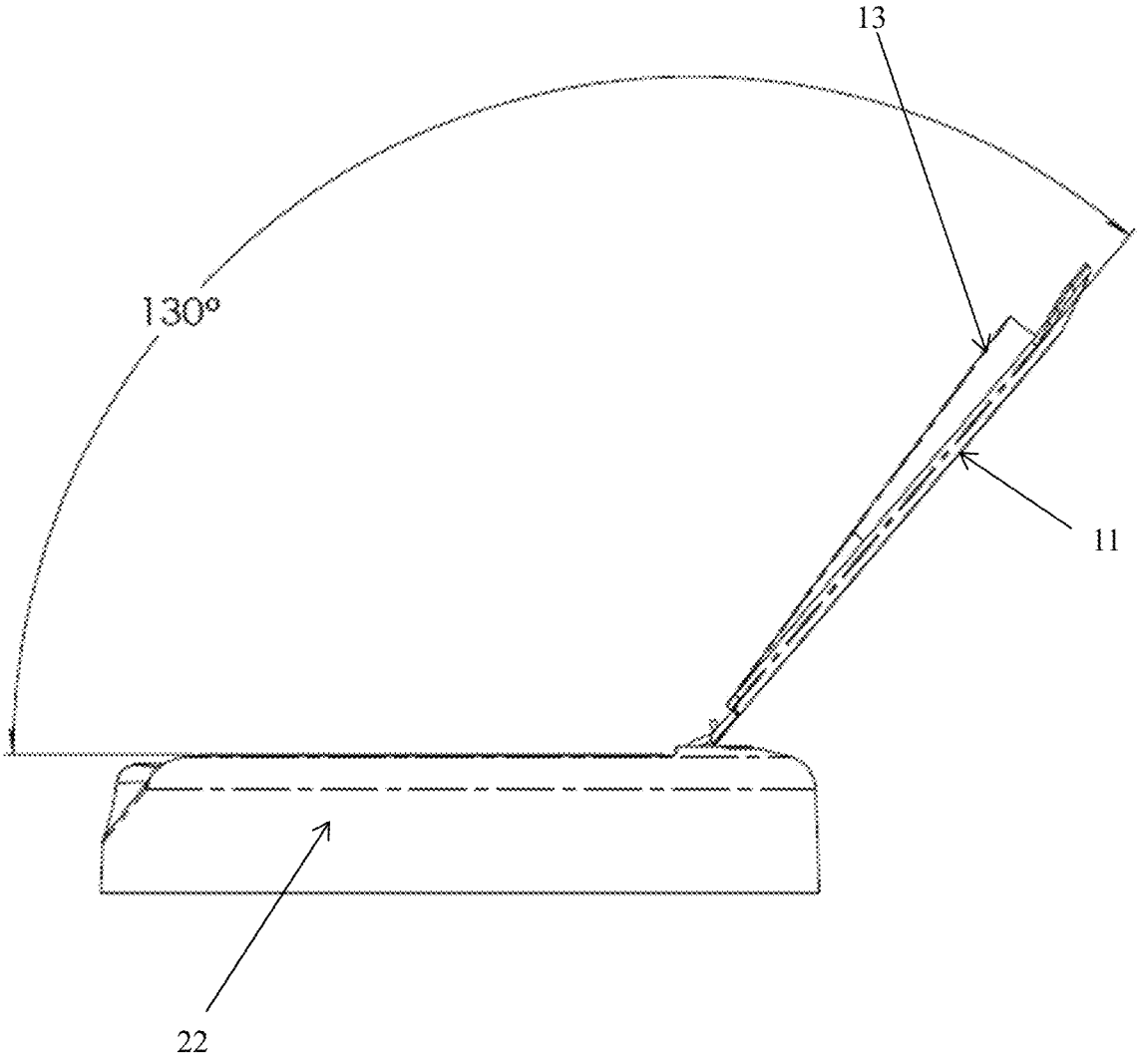
FIG. 10: Side view of the opened 2 piece canister closure Assembly of the present invention.
Figure 11:
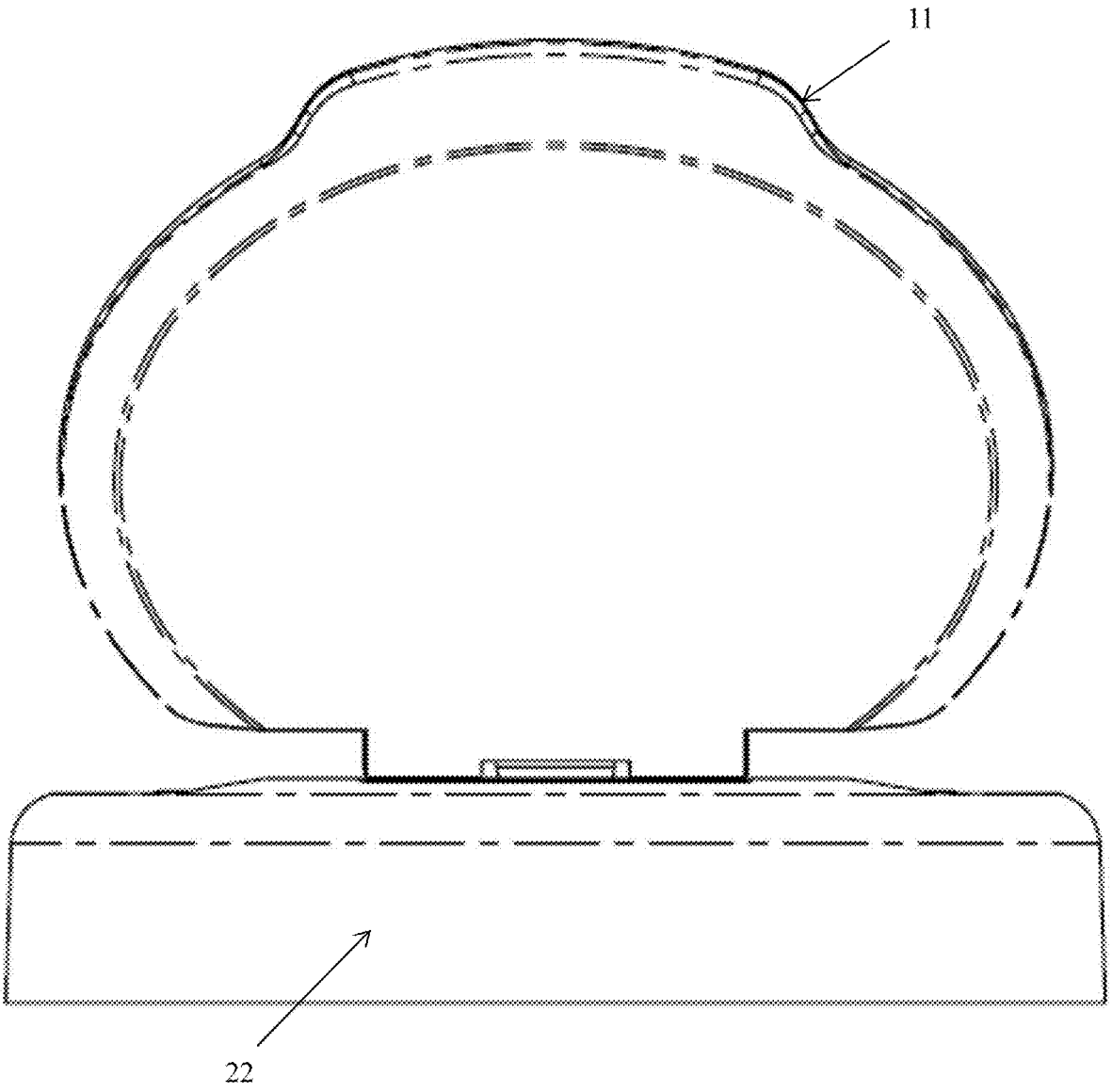
FIG. 11: Back View of the opened 2 piece canister closure Assembly of the present invention.
Figure 12:
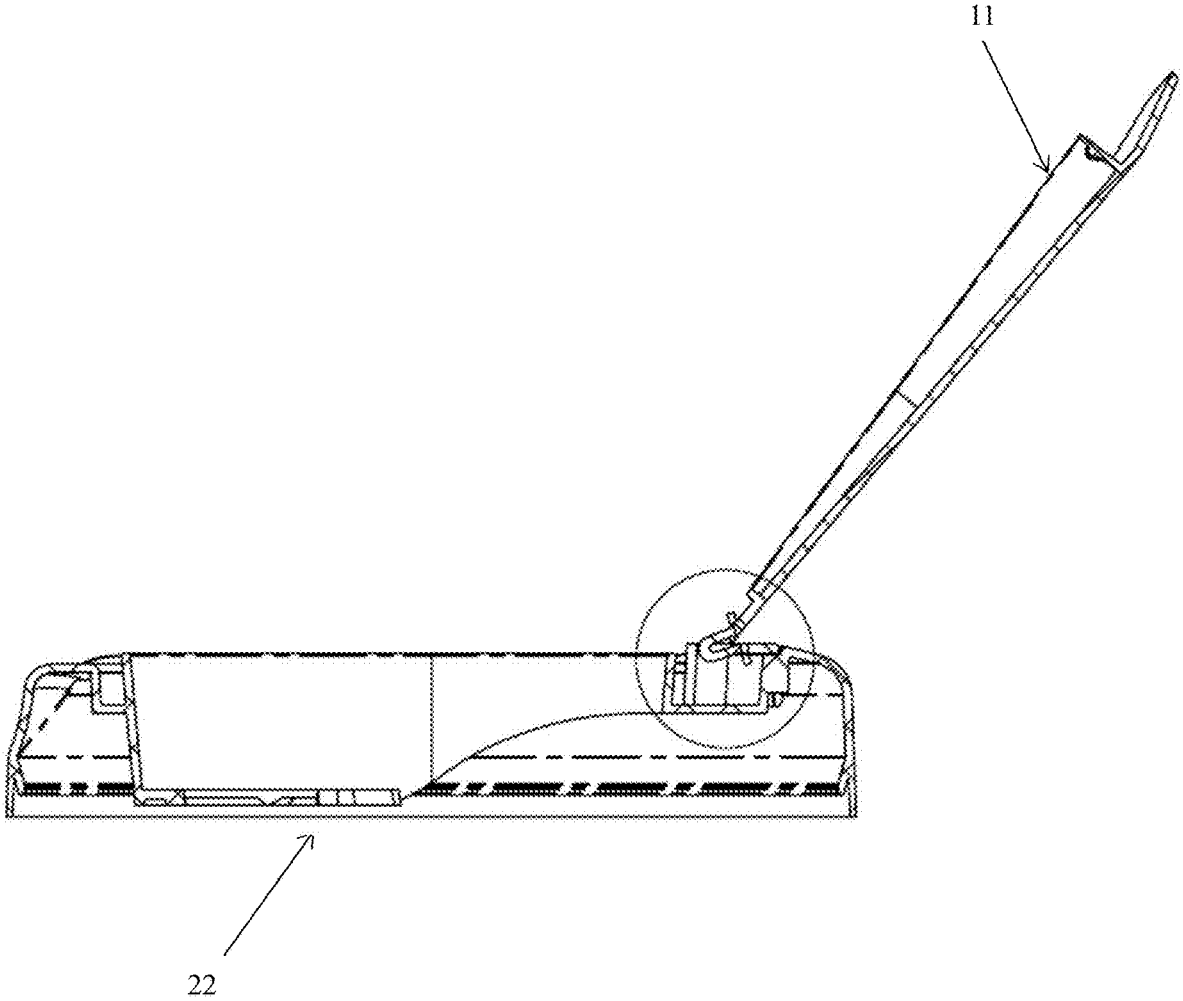
FIG. 12: Side section view of the opened 2 piece canister closure Assembly of the present invention.
Figure 13A:
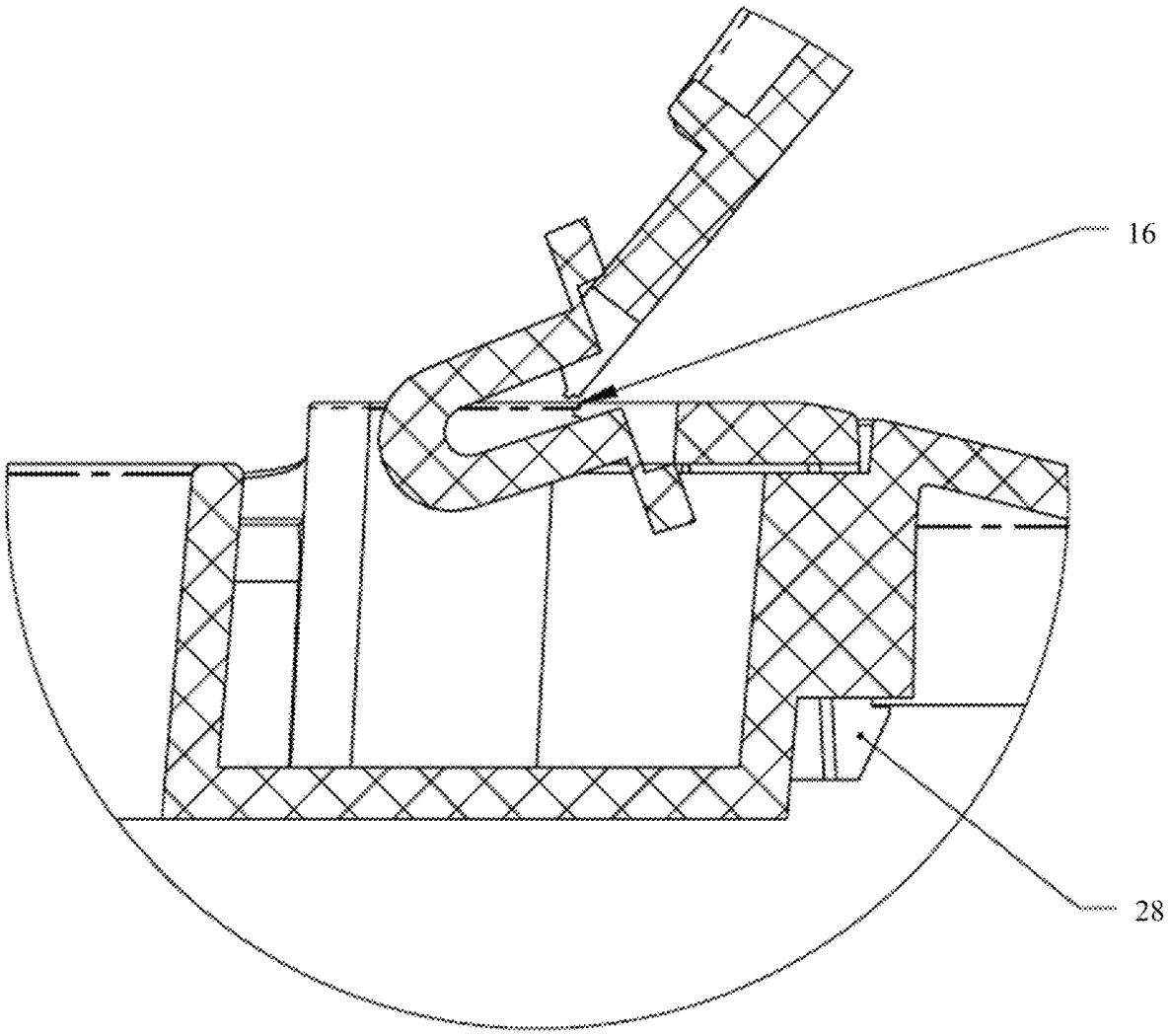
FIGS. 13*a*-13*b*: Close-up on the 2 piece canister closure on a canister elastic hinge area with notes on the stopper geometries.
Figure 13B:
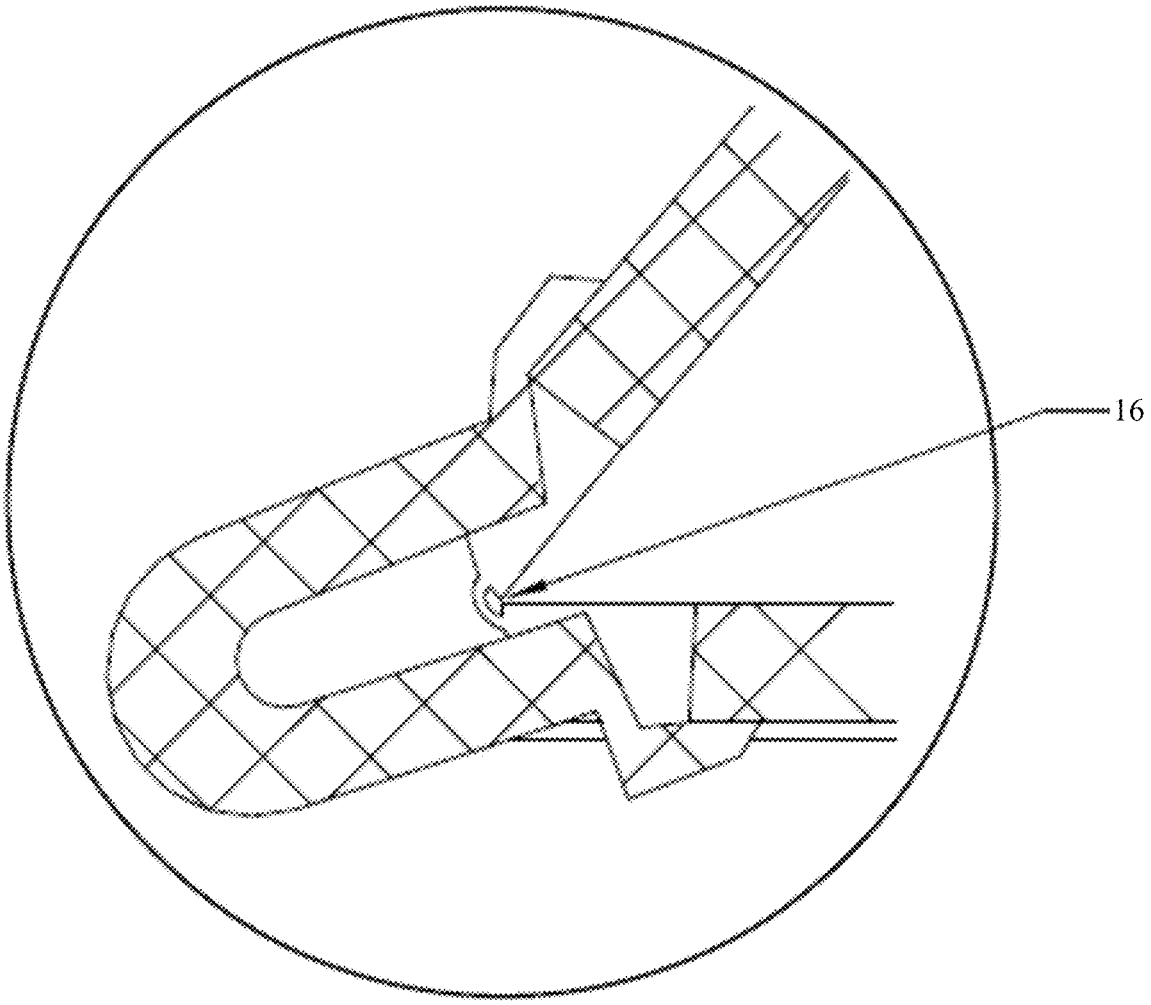
Figure 14:
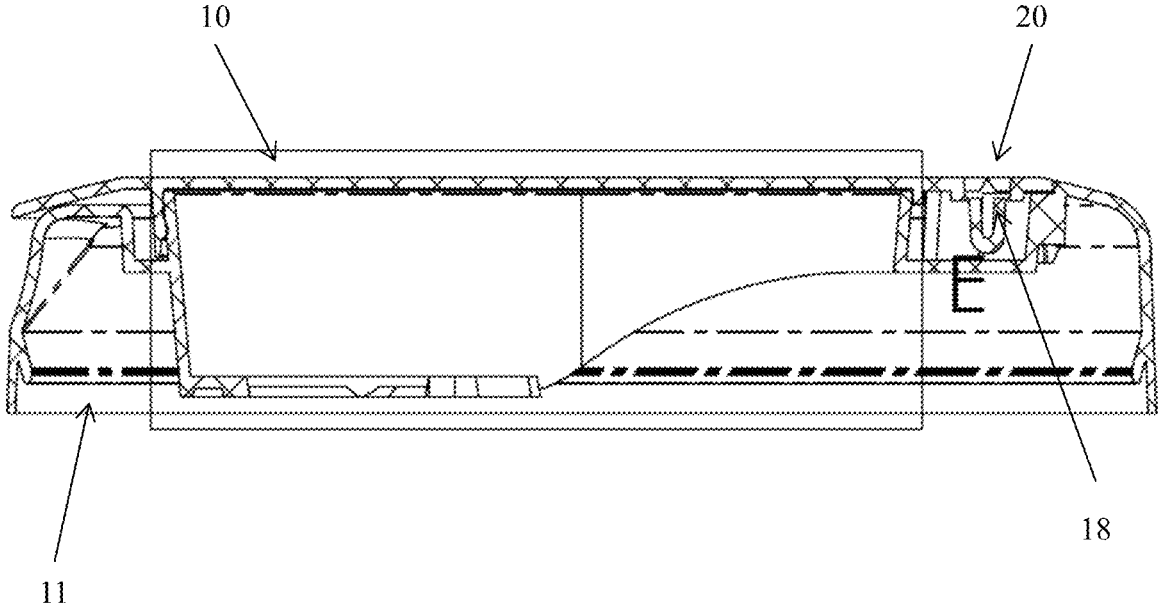
FIG. 14: Side section view of the closed 2 piece canister Assembly.
Figure 15:
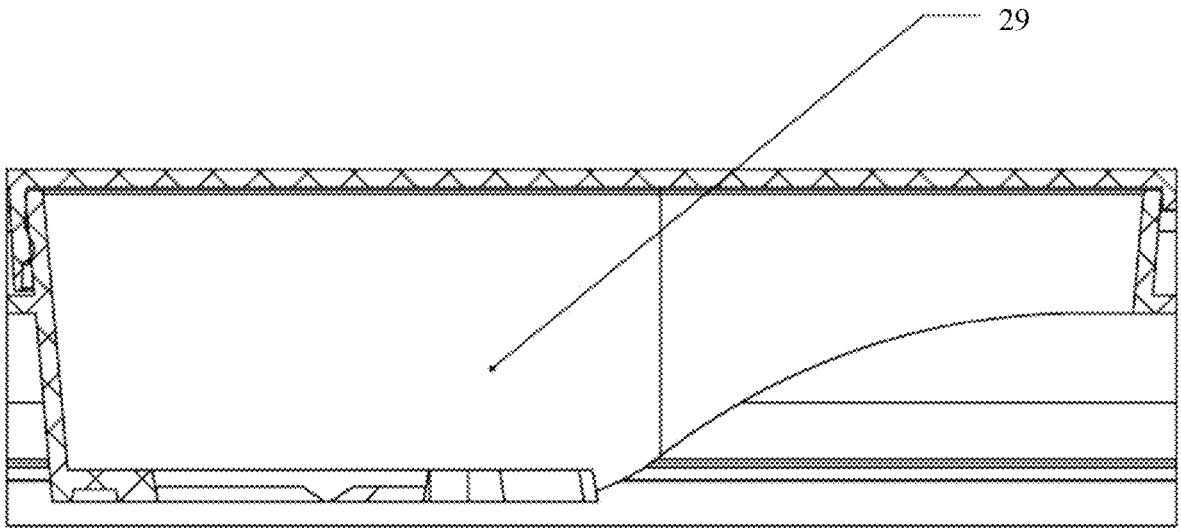
FIG. 15: Close-up of tail storage.
Figure 16:
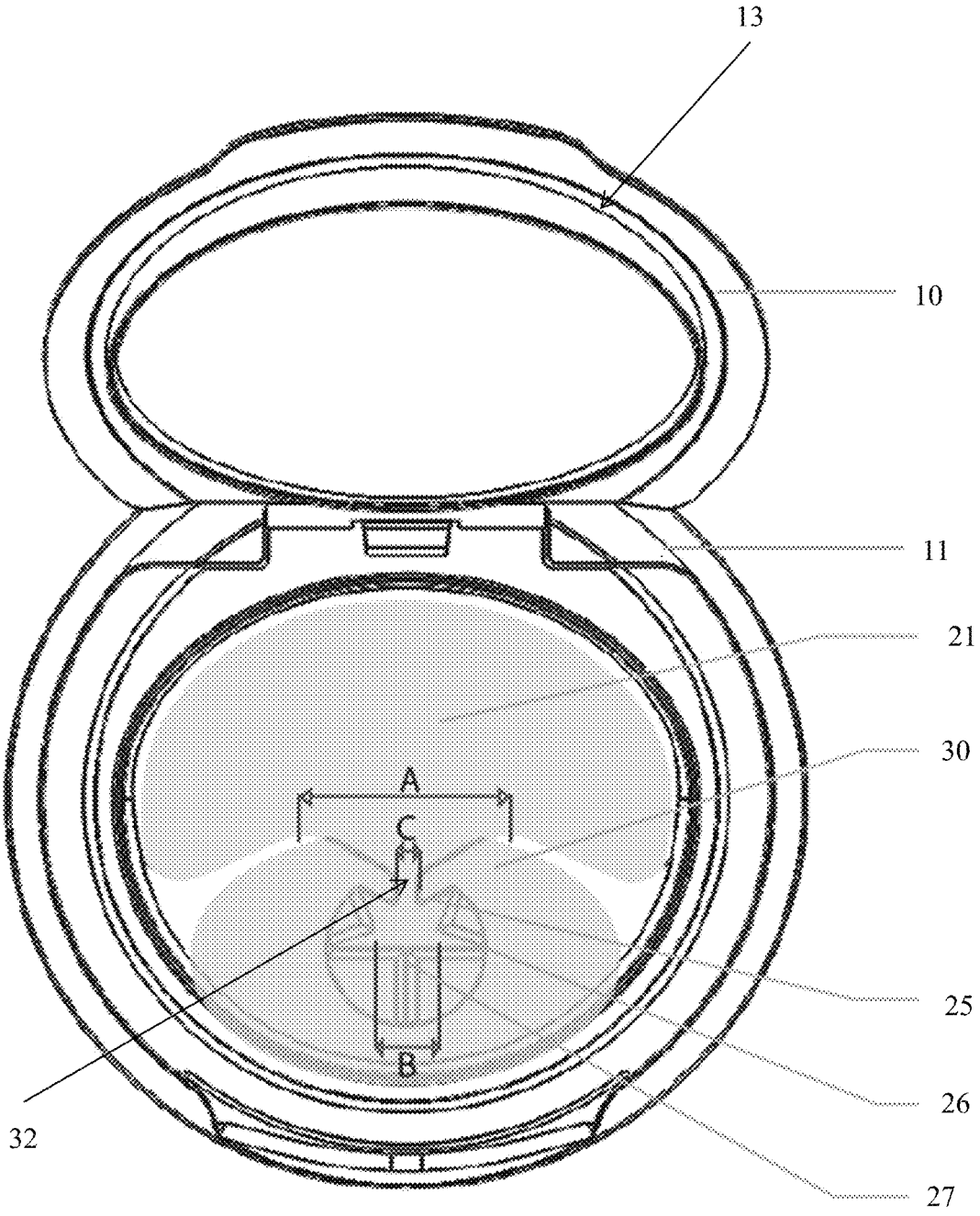
FIG. 16: Illustration of main area and distance A, B and C.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

The present invention is a two piece wet-tissue canister 9 closure with a lid 10 and a cap 11. The present invention has a lid 10 that can be open with a flip of a finger, once opened, the lid 10 will hold its position with the help of a stopper 33 and the force stored in an elastic u shaped spring hinge 18. This will provide the user with a very open and clear view of the canister 12 content. If it's a first time use, the user may reach the content through a wide orifice 24 through the lid body 13, and pull the lead of the roll through it, then, by passing towards the tearing and holding pattern orifice 24, the user will be able to cleanly tear one sheet, the holding pattern holding the thread in place ready for later use. The user then flips the lid 10 down in order to close it.

The present invention allows the lid 10 to be open and hold still in the opened position by a very simple flip up motion. The closing is also a simple flipping movement.

The present invention also requires the user to use a certain amount of force to open it avoiding accidental opening in case the closure fall on the ground and in the same way, it requires a certain amount of force to trigger the closing motion when it is holding still in its opened position preventing accidental or non-requested closing motion. Therefore, the lid 10 is not leaning on the back of the hand of the user which prevents the user from wetting his hand with potential condensed moisture present on the inner face of the lid 10.

The present invention also helps the user get a single sheet at a time and not fiddling with the roll or not requiring the user to use his two hands to tear the roll by himself.

The present invention also provides the big storage area for the tissue tail, to avoid jamming the tail in between the sealing rib 31 of the lid 10 and sealing ribs 31 of the cap 11.

The present invention's two piece construction allows the design to avoid hard corners on the external envelope that a living hinge 20 would leave. On the present invention, the living hinge 20 is part of the lid 10 unlike those taught in the prior art.

Compared to a conventional living hinged closure, the present invention does not have a tendency to close on itself, because once assembled and in a close position, the hinge area is in an open state, opposed to close on conventional living hinged closure, when one opens the lid 10, the hinge is close, it minimizes the time where the living hinge 20 is under stress. The lid 10 opening lip is in a recess area of the cap 11 and guides the user to flip it open. Then, the lid 10 will stay still at a preset angle, which no existing product achieves, it also invites the user to flip it down or push it down, once pushed enough, the stored elastic force will take over and pull the lid 10 close on the cap 11.

Compared to the conventional closures, the present invention can keep the overall cap 11 body shape free from hard corners sticking up left by the living hinge 20 design.

Compared to conventional reach-in and tearing area, the user can reach the content of the canister 12 without having to take the cap 11 off the canister 12. The present invention also allows the user to avoid a lengthy threading experience, as the latter is done as the user takes its first sheet of tissue.

Compared to the conventional closures, the present invention provides enough space to store the tail remaining from a wide range of tissue, perforation, and lotion combinations.

The present invention is composed of one lid body 13, one cap 11 with an orifice 24 integrated to the latter, attached together by means of snap fitting method or other fastening method. The lid body 13 is made by the lid 10 itself, a latch 14, some stopper geometries 16, one built into the living hinge 20 and another built into the retaining hooks 17, a u spring hinge 18, a sealing rib 15 and retaining hooks 17. The cap 11 is made with one or more retaining slots 23, a canister 12 snapping feature 19, a shell body 22, in the middle of this body, the present invention has an orifice 24 for content access. The orifice 24 area has two main parts, a reach-in area 21 and a hold and tear area. The tear area has three sets of teeth, the guiding teeth 25, the front teeth 26 and back teeth 27.

The lid 10 is assembled to the cap 11 through a snap fitting lock, the lid 10 can then pivot around an axis and hold on that preset angle, the cap 11 has an orifice 24 in its middle section. When the lid 10 is closed, it covers a maximum of the orifice's area in order to provide a good moisture sealing barrier. On the orifice 24, there are two sections, the reach-in area 21 and in front of it towards the user, the present invention has a V shaped area formed by the guiding teeth 25, which leads the tissue into the core of the hold and tear area where the present invention has the front teeth 26 and the back teeth 27. Moving towards the front, the teeth get narrower, the back teeth gaps are 0.1 mm, while the guiding teeth 25 and front teeth 26 provides a wider opening. The tail storage 29 provides the space to keep the tissue tail after the first tissue is dispensed.

When the user wants to open the lid 10, he places his thumb over the recess area and simply pushes up; this will flip the lid 10 opened. The lid 10 will rotate around the elastic U shaped spring 18 and this U shaped spring 18 will store elastic energy, then, when the lid 10 reaches a stopper geometry 16, it will hold still at a preset angle (the example uses 130 degrees, the inventors expect the range of 100 to 160 being the best suited for best user experience, anything between 100 to 180 degrees is possible).

While opened, in order to take a piece of tissue, the user picks it through the reach-in area 21 or the orifice 24, he pulls a sufficient length of tissue so that he can securely grab it and move it towards the tear and hold area without having his hands touching the tear area 30. At that moment, the tissue will be guided by the guiding teeth 25, these teeth are designed so that the top of the gap between them (distance "A") is between 6 mm to 31 mm, this provide an opening wide enough so that the user can move the tissue through that gap. The tip of the guiding teeth 25 and front teeth 26 are separated from each other and provide a gap which measures 2 to 10 mm (distance "B").

During the inventor's research, they found out through experimentation that a ratio between A and B of A/B=2.5 to A/B=3.5 provides the best dispensing experience.

Moreover, the guiding gap 32 (distance "C") is designed in 2 mm to provide the sufficient area for the tissue, while the guiding gap could provide the good performance in between 1.5 mm to 5 mm depends on the type of tissue.

Once the tissue is moved in the core of the tearing area 30, the tissue will slide over the guiding teeth 25 and front teeth 26 and the guiding teeth 25 and front teeth 26 will grab the tissue's perforations, once one or two teeth grab sufficient perforations, the tearing process will take place and tear the tissue off the roll as the user continues to pull on the piece of tissue. As the tissue does not snap off the roll but is torn progressively, the following piece of tissue will follow and will stick from the surface of the tearing area, leaving a thread for the next dispensing phase. The fact that the back teeth 27 are so closed to each other, leaving a 0.1 mm gap, the back teeth 27 will pinch the tissue, helping the tearing process. The tail storage 29 is provided for a wide range of tissue tail.

When the user wants to close the lid 10, he simply flip and push forward the lid 10 until the lid 10 flips down by itself as the u spring 18 releases its elastic energy, aligning the lid's 10 sealing rib "A" 31 with the sealing rib 15 from the cap 11. Then, the user must push the lid 10 down a little bit further until he hears a click sound meaning that the latch 14 has engaged to secure the closing.

The invention will be made out of plastic in an injection molding process; a post molding process will assemble the two parts together.

All the items are necessary for a complete dispensing experience, but elements can be single out for if an embodiment of the present invention needs only part of the function, for example, if an embodiment of the present invention only needs to have the lid 10 that stays opened at a certain angle, an embodiment of the present invention only needs the lid 10 with the stopper 33. The user flips the lid 10 to open it form the cap 11, take a sheet of wet tissue, thread it and tear it through the tear and hold orifice, then flips it again to close.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A two piece wet-tissue canister device with an elastic hinge with an opening angle stop and a single sheet dispensing orifice, the device consisting of:

one lid body;

one cap with an integrated orifice;

the cap is made with a retaining slot, a canister snapping feature, a shell body, and in the middle of the cap body an orifice for content access;

the lid body and cap attached together by a snap fitting;

a latch;

a spring hinge;

a sealing rib;

one or more retaining hooks; and two or more stopper geometries, one built into a living hinge and another built into the one or more retaining hooks.

2. The device of claim 1, further comprising an orifice area, wherein the orifice area has three main parts;

a reach-in area;

a hold and tear area; and a tail storage area.

3. The device of claim 2, wherein the hold and tear area has three sets of teeth; a set of guiding teeth, a set of front teeth, and a set of back teeth.

* * * * *